US009003941B1

(12) United States Patent
Jaure, III

(10) Patent No.: US 9,003,941 B1
(45) Date of Patent: Apr. 14, 2015

(54) SELF-ADHESIVE ACTIVITY PAPER SYSTEM

(76) Inventor: Demetrio R. Jaure, III, Tucson, AZ (US)

( * ) Notice: Subject to any disclaimer, the term of this patent is extended or adjusted under 35 U.S.C. 154(b) by 394 days.

(21) Appl. No.: 13/494,070

(22) Filed: Jun. 12, 2012

(51) Int. Cl.

| | |
|---|---|
| ***B26D 5/08*** | (2006.01) |
| ***B26D 7/00*** | (2006.01) |
| ***A61C 15/04*** | (2006.01) |
| ***B26F 3/02*** | (2006.01) |
| ***B65H 35/00*** | (2006.01) |

(52) U.S. Cl.
CPC ..... *B65H 35/0046* (2013.01)

(58) Field of Classification Search
USPC ..... 83/649, 332, 614; 206/38, 394, 411, 206/407, 409; 401/195, 52; 15/435; 242/564.1; 225/45, 48, 50, 6, 13, 49
See application file for complete search history.

(56) References Cited

U.S. PATENT DOCUMENTS

| | | | | |
|---|---|---|---|---|
| 594,485 | A * | 11/1897 | McMillan | 242/584 |
| 2,031,033 | A * | 2/1936 | Denebeim | 225/47 |
| 4,989,801 | A * | 2/1991 | Thomas et al. | 242/588 |
| D316,789 | S * | 5/1991 | McLaughlin | D6/522 |
| 5,196,246 | A | 3/1993 | Kauss et al. | |
| 5,598,987 | A * | 2/1997 | Wachowicz | 242/597.8 |
| 6,251,500 | B1 | 6/2001 | Varga et al. | |
| 7,614,813 | B1 * | 11/2009 | Yande | 401/150 |
| D699,469 | S * | 2/2014 | Flood | D6/518 |
| 2005/0022439 | A1 | 2/2005 | Crump | |
| 2006/0213101 | A1 | 9/2006 | Sobonya et al. | |

OTHER PUBLICATIONS

Tempaper. Tempaper By You. http://www.tempaperdesigns.com, Dated May 11, 2011.

Frames by Taylor & Wood. http://www.grahambrown,com/uk/product/52050/Frames/0, Dated May 11, 2011.

* cited by examiner

*Primary Examiner* — Ghassem Alie

(74) *Attorney, Agent, or Firm* — Robert C. Montgomery; Montgomery Patent & Design

(57) ABSTRACT

A self-adhesive activity paper applicator dispenses a strip of paper from an internal roll directly onto a wall and then cuts it to length. The activity paper comprises pre-applied strips of temporary pressure-sensitive adhesive, beneficially having preprinted images. The applicator covers part of a wall to allow a child to color or draw upon the paper. When the child is done drawing the activity paper can be removed without damaging wall. The applicator has a pair of handles and a bottom wheel that facilitates accurate and level deployment of paper. The applicator may be disassembled to refill the paper roll.

20 Claims, 8 Drawing Sheets

SELF-ADHESIVE ACTIVITY PAPER SYSTEM

RELATED APPLICATIONS

There are currently no applications co-pending with the present application.

FIELD OF THE INVENTION

The presently disclosed subject matter is directed to child drawing activities. More particularly the invention relates to self-adhesive activity paper applicators that dispense child drawing and activity paper from an internal roll onto a wall and cuts it to length.

BACKGROUND OF THE INVENTION

Even in this age of computer art, interactive educational software, and realistic computer gaming, age old activities such as finger painting and coloring with crayons remain favorite activities for children. The available rainbow of colors coupled with their ease of use, classic touch, feel and scent, makes coloring a widely enjoyed pastime. Its low cost and ease of use also makes coloring popular with care-givers, particularly when care is being given to more than one (1) child. Furthermore, coloring is frequently used to aid the development of young children.

Unfortunately many children just beginning to learn how to use finger paints and crayons end up using room walls as their canvas. In fact drawing on vertical surfaces is often preferred by some children. Caring for multiple children only makes this problem worse. This not only quickly makes a room look disastrous but removing crayon from walls can be very difficult and often a complete repainting of the room is required.

Accordingly, there exists a need for some way by which children can be allowed to express their creativity by coloring upon walls without damaging those walls.

SUMMARY OF THE INVENTION

This invention utilizes a vertical dispensing system which dispenses a strip of paper from an internal spool. This strip of paper would be approximately eight to seventeen inches (8-17 in.) wide depending upon the individual model. The paper is held to the vertical wall surface by use of removable adhesive strips similar to those used on POST-IT® notes. A suitable amount of paper would be dispensed depending upon the size of the room or other conditions of use. It is envisioned that the paper reel would be provided with preprinted character outlines in a wide variety of themes depending upon the child's age and sex. Some examples include stuffed animals for younger children, animals or cartoon characters for older children, and the like. The invention permits a child to color on the paper while it is on a wall. This not only stimulates creativity, but also protects the wall from marks. When the child has completed coloring or otherwise becomes bored, the invention can be removed leaving no telltale marks behind. The dispensing system has two (2) handles and an extended wheel to enable accurate and level deployment of activity paper.

A paper system that is in accord with the present invention includes an elongated cutter body having an elongated paper slit. Attached to the cutter body is an elongated transparent cylinder that includes an elongated paper slot that encompasses the paper slit. The cylinder has a threaded top, a threaded bottom, and a handle. An upper cap having a top handle and an upper spool receiver is screwed onto the top of the cylinder while a lower cap having a wheel and a lower spool receiver is screwed onto the bottom. Disposed between the upper and lower spool receivers is a paper spool for holding activity paper. The paper system further includes a cutter assembly having a blade that is located within the cutter body and which passes through the paper slit.

Activity paper having horizontal temporary adhesive strips on its backside can be mounted on the paper spool and extended through the paper slit. Such paper can be preprinted with indicia such as letters, pictures, and lines. Beneficially the paper spool can be removed by detaching either the upper cap or said lower cap, and the cylinder can be detached from the cutter body, inverted, and then reattached. To that end, the cylinder includes a plurality of symmetrically arranged apertures and the cutter body includes a plurality of symmetrically apertures connector tangs which are used to attach the cutter body to the cylinder.

To assist applying the activity paper to a wall, the cutter body holds a plurality of rollers that extend from the cutter body near the cutter slit. To protect the walls the rollers are beneficially felt covered and are arranged in pairs.

The paper system includes an "L"-shaped elongated cutting slot that extends from a surface adjacent the cylinder through the paper slit. The cutter assembly includes a cutter actuator that is coupled to the blade and which extends from the cutting slot. The cutter actuator can move along the cutting slot to slide the blade along the paper slit to cut the activity paper that extends from the paper slit. Preferably the blade is connected to the cutter actuator by cutter plate, and the cutter actuator extends from the cutting slot using a button-shaped handle.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
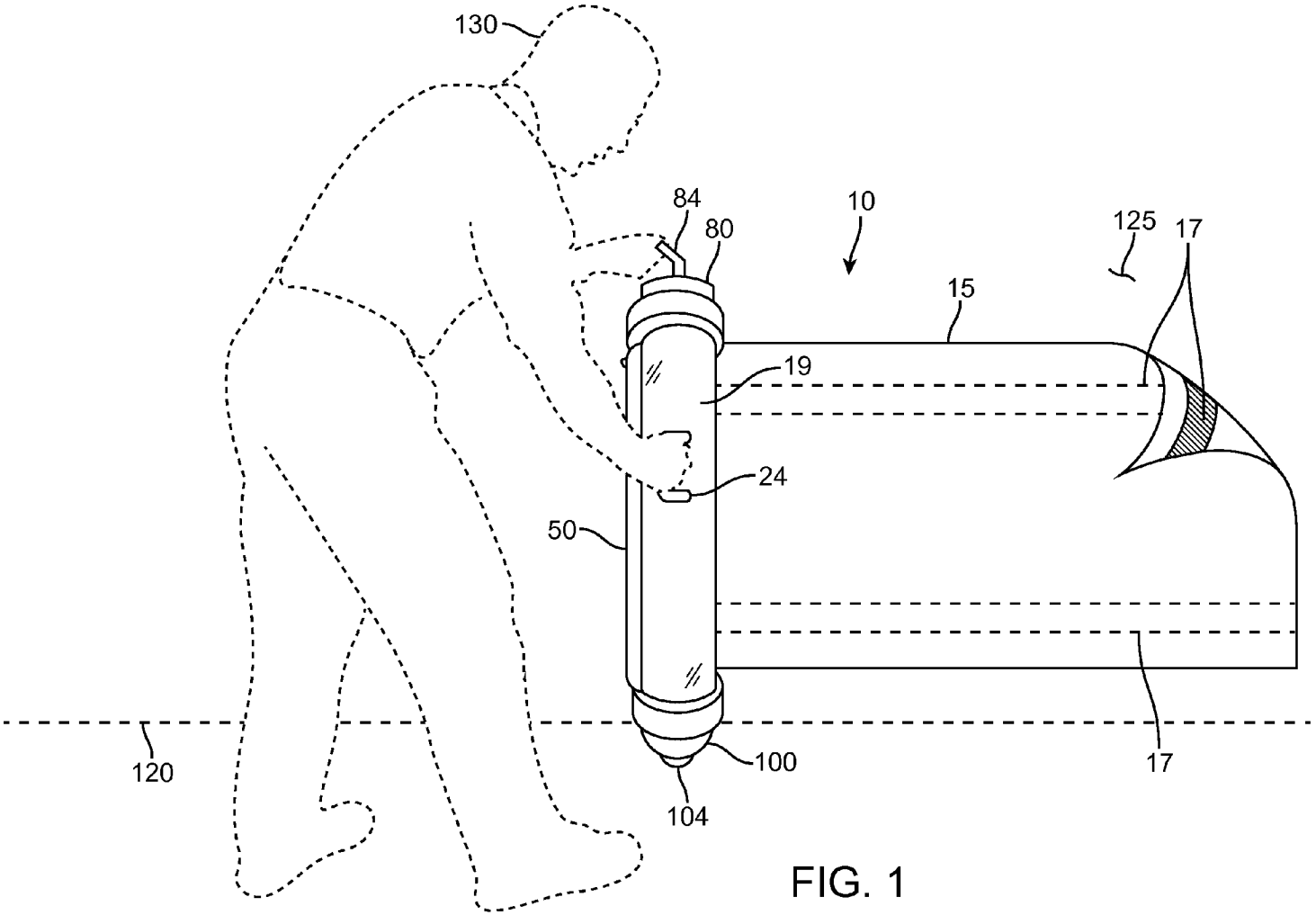
FIG. 1 is an environmental view of an in-use self-adhesive paper system 10 according to a preferred embodiment of the present invention.

10 self-adhesive paper system
15 activity paper
17 adhesive
19 applicator
20 cylinder assembly
22 cylinder body
23 cylinder paper slot
24 cylinder handle
26*a* upper male threaded region
26*b* lower male threaded region
28 connector aperture
50 cutter assembly
52 cutter body
54 cutter actuator
56 slider slot
57 slider plate
58 connector tang
60 cutter slit
62 roller
63 roller axle
64 cutter blade
65 blade slot
66 cutter assembly paper slit
80 upper cap assembly
82 upper cap
84 upper cap handle
85 rotational feature
86 upper cap female threaded region
88 upper spool receiver
90 paper spool
100 lower cap assembly
102 lower cap
104 wheel
105 wheel axle
106 lower cap female threaded region
108 lower spool receiver
120 floor
125 wall
130 user

DETAILED DESCRIPTION OF THE PREFERRED EMBODIMENT

The best mode for carrying out the invention is presented in terms of its preferred embodiment, herein depicted within FIGS. 1 through 8, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The principles of the present invention provide for a child drawing and activity paper applicators for quickly applying easily removed activity paper to walls. FIG. 1 shows an environmental view of a preferred embodiment child drawing and activity paper applicator in the form of a self-adhesive paper system 10. The self-adhesive paper system 10 applies a removable adhesive-backed activity paper 15 onto a wall 125 so that children can draw on the wall without damage. The self-adhesive paper system 10 uses an applicator 19 which dispenses a horizontal strip of the activity paper 15 onto the wall 125 from a paper spool 90 (reference for example FIG. 3). A cutter assembly 50 is then used to vertically cut the activity paper 15 at a desired length.

The activity paper 15 is envisioned as being approximately three feet (3 ft.) high and up to fifty feet (50 ft.) in length. However, it should be understood that different heights and lengths of activity paper 15 may be used based on a user's 130 preferences. Thus, the envisioned dimensions should not be interpreted as a limiting factor of the self-adhesive paper system 10. The activity paper 15 adheres to the wall 125 using pre-applied temporary adhesive 17 that is located on the back of the activity paper 15. Ideally the adhesive 17 is deployed in horizontal stripes. The adhesive 17 beneficially comprises a compound similar to that used on POST-IT® notes. The self-adhesive paper system 10 permits a child to color on the activity paper 15 while protecting the wall 125 from crayon markings and other associated damage. When the child has completed coloring, the activity paper 15 can be removed without leaving marks or damaging the wall due to the temporary nature of the adhesive 17.

The activity paper 15 as illustrated herein as a plain white activity paper 15 having two (2) strips of adhesive 17. However, the activity paper 15 may be preprinted with a variety of themes, characters, designs, borders, colors, and the like.

Still referring to FIG. 1, the applicator 19 comprises two (2) handles 24, 84 and a bottom wheel 104. This arrangement allows the user 130 to apply the activity paper 15 using the handles 24, 84 while the self-adhesive paper system 10 glides over the floor 120 on the bottom-mounted wheel 104. This configuration of handles 24, 84 and wheel 104 enables parallel dispensing of activity paper 15 onto the wall 125 with respect to the floor 120. The self-adhesive paper system 10 further includes threaded cap assemblies 80, 100 which may be unscrewed and removed to enable easy refill of the activity paper 15 (see FIG. 3).

Figure 2:
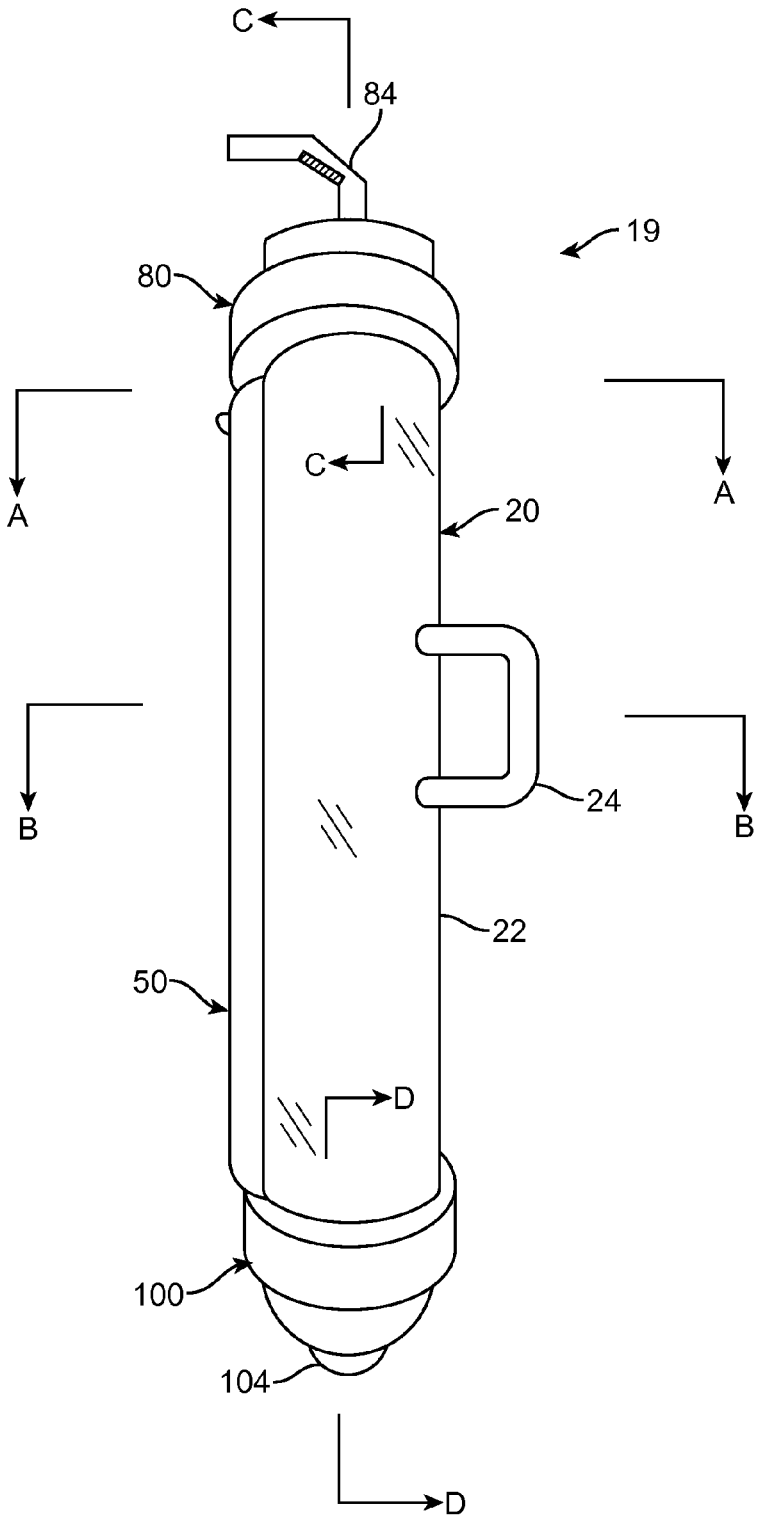
FIG. 2 is a front perspective view of an applicator 19 used in the self-adhesive paper system 10 shown in FIG. 1.

Refer now to FIG. 2, a front perspective view of an applicator 19 used in the self-adhesive paper system 10. The applicator 19 enables dispensing the activity paper 15 accurately onto the wall 125. The applicator 19 is a segmented assembly including a transparent cylinder assembly 20, a directionally configurable cutter assembly 50, the upper cap assembly 80, and the lower cap assembly 100 (see FIG. 3).

Figure 3:
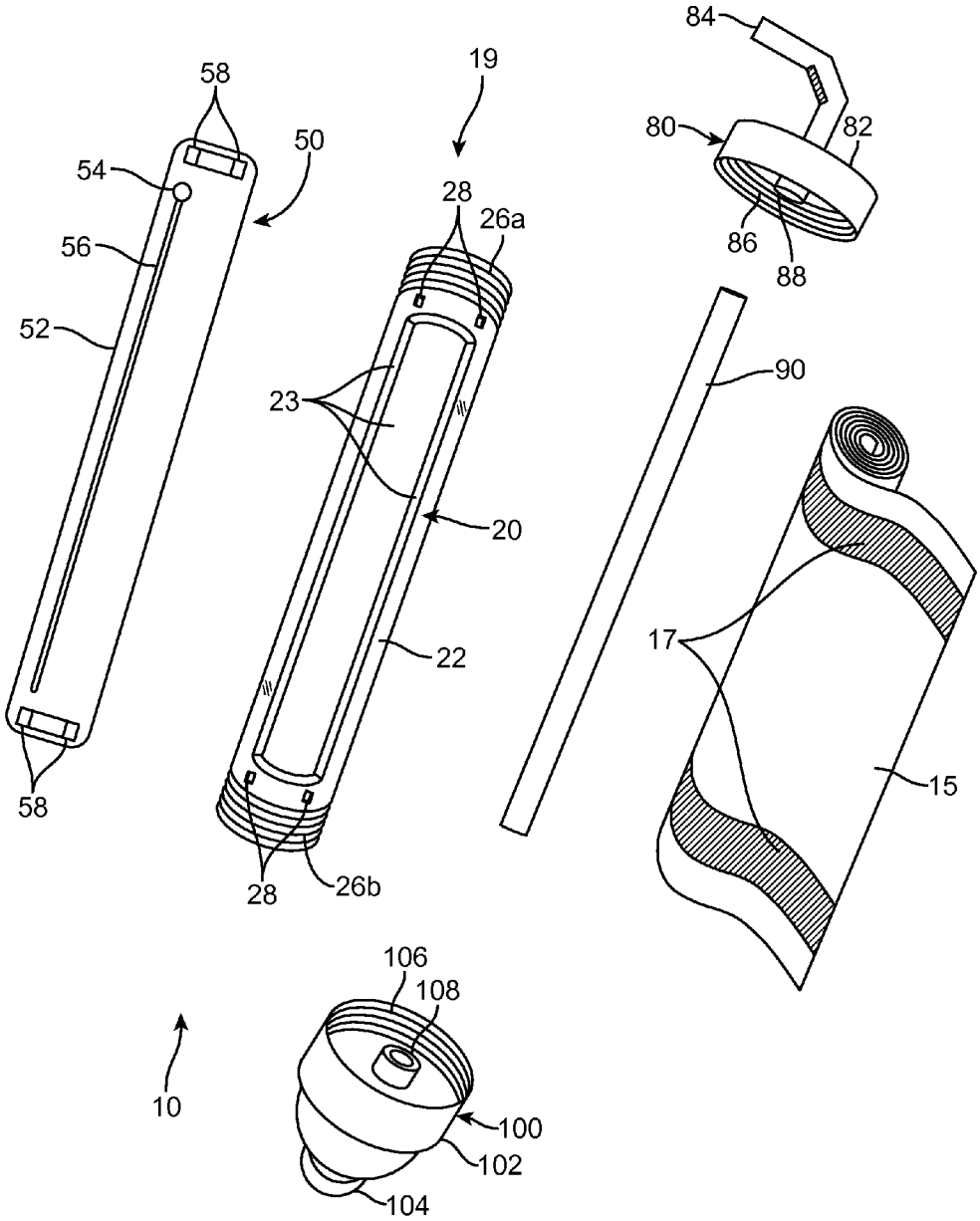
FIG. 3 is an exploded view of the self-adhesive paper system 10 shown in FIG. 1.

FIG. 3 shows an exploded view of the self-adhesive paper system 10. The cylinder assembly 20 retains a cylindrical roll of activity paper 15 so it can be dispensed on the wall 125 (see FIG. 1). As shown, the cylinder assembly 20 comprises a hollow cylindrically-shaped cylinder body 22 made of a durable transparent plastic. The cylinder body 22 has a front positioned, substantially rectangular paper slot 23, an upper male threaded region 26*a* for attachment of the upper cap assembly 80, a lower male threaded region 26*b* for attachment of the lower cap assembly 100, and connector apertures 28 both above and below the paper slot 23. The apertures 28 enable removable attachment of the cutter assembly 50. The upper 80 and lower 100 cap assemblies respectively provide an upper spool receiver 88 and a lower spool receiver 108 which secure the paper spool 90 along the centerline of the applicator 19. As noted the activity paper 15 is mounted on the paper spool 90.

The cutter assembly 50 attaches to the cylinder body 22 via a plurality of integral protruding barbed connector tangs 58 which are inserted into and retained within the connector aperture 28. The connector tangs 58 are beneficially symmetrically arranged to enable inverted attachment of the cutter assembly 50. This enables easy dispensing and cutting of the activity paper 15 on the wall 125 either towards the left or right (also see FIGS. 4*a*, 4*b*, 5*a* and 5*b*).

Figure 4A:
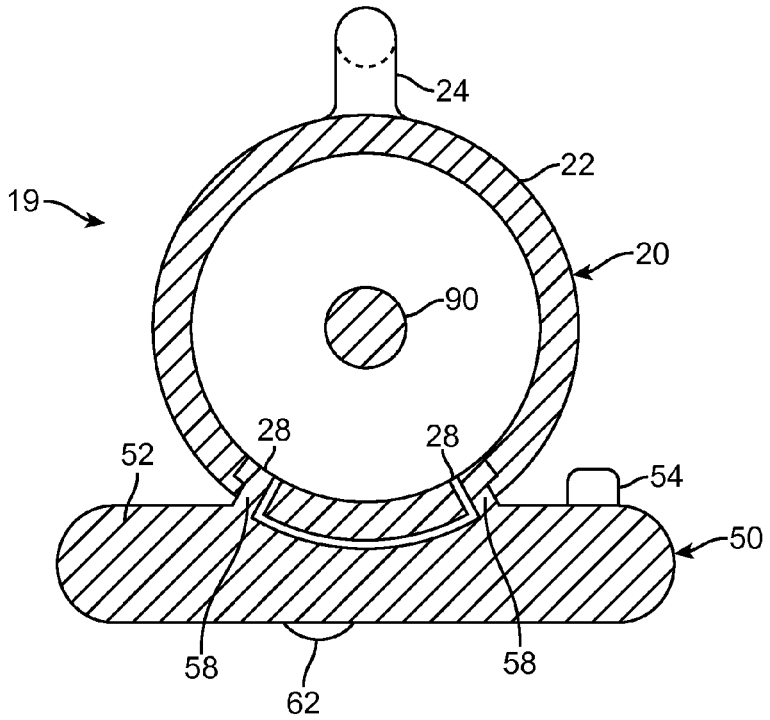
FIG. 4*a* is a section view of the self-adhesive paper system 10 taken along section line A-A of FIG. 2.
Figure 4B:
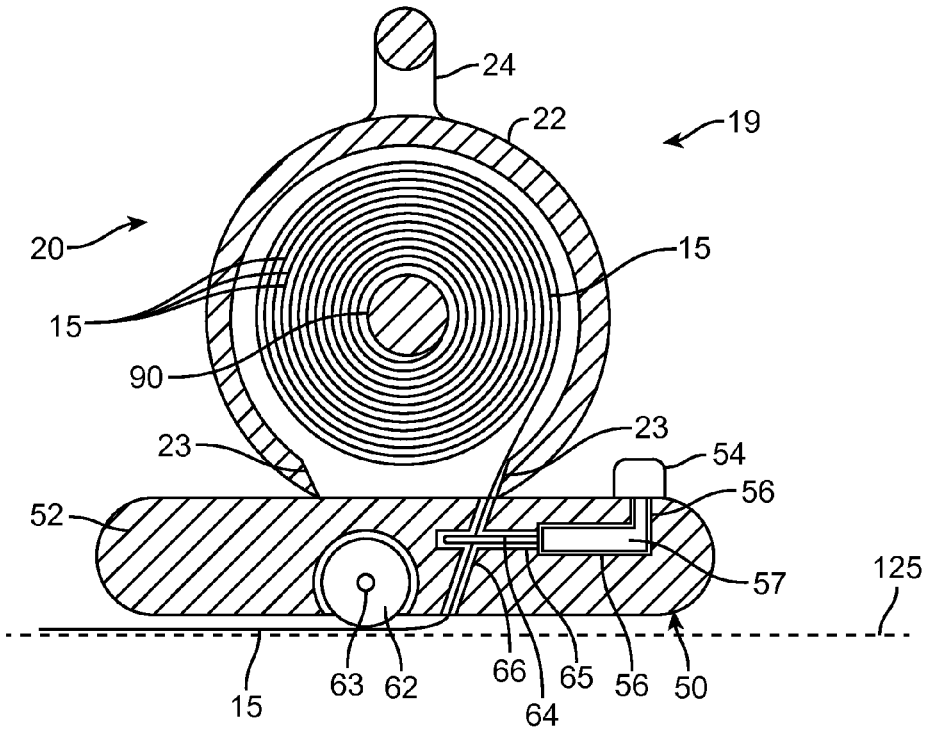
FIG. 4*b* is a section view of the self-adhesive paper system 10 taken along section line B-B of FIG. 2.

Referring now to FIGS. 4*a* and 4*b*, section views depicting attachment and cutting, the cutter assembly 50 is attached to the cylinder assembly 20 via corresponding and interlocking connector apertures 28 and connector tangs 58. The connector tangs 58 are inserted into the connector apertures 28 where they "snap" fit. The connector tangs 58 are easily removed from the connector apertures 28 by "unsnapping" them. This enables quick and easy detachment of the cutter assembly 50 from the cylinder assembly 20 when desired.

Attachment of the cutter assembly 50 to the cylinder assembly 20 allows routing activity paper 15 within the cylinder body 22 through the cylinder paper slot 23 and subsequently through a cutter assembly paper slit 66 of the cutter assembly 50. The cylinder paper slot 23 is made with right and left side mirror-image surfaces that guide the activity paper 15 through the paper slit 66.

From the paper slit 66 the activity paper 15 is routed between the wall 125 and exterior rollers 62 of the cutter assembly 50. The cutter assembly 50 operates along an ovular-shaped cutter body 52 which is beneficially a solid plastic structure similar in height to the cylinder body 22.

The cutter assembly 50 provides for attachment of paper-cutting devices including a cutter actuator 54, a guiding slider plate 57, and a cutter blade 64. The cutter blade 64 comprises a metal razor blade-like tool configured to accurately cut the activity paper 15 vertically. The cutter blade 64 is manually actuated and guided by the cutter actuator 54 and slider plate 57. The cutter blade 64 is similar to the commercial and consumer devices used to cut cellophane, various paper products, and the like.

The cutter blade 64 and the slider plate 57 are internally captivated and linearly guided within the cutter body 52 via respective blade slot 65 and slider slot 56. The blade slot 65 and the paper slit 66 cross over each other, thereby enabling the activity paper 15, which is supported within the close-fitting paper slit 66 to be accurately and cleanly cut by the cutter blade 64. The cutter actuator 54, slider plate 57, and cutter blade 64 constitute a unitary structure with the slider plate 57 being located at the end of the cutter blade 64. The cutter actuator 54, slider plate 57, and cutter blade 64 are moved vertically by a user 130 via manual manipulation of the externally protruding cutter actuator 54. The slider plate 57 and the cutter actuator 54 are vertically guided within the "L"-shaped slider slot 56 which is molded within the cutter body 52.

Figure 5A:
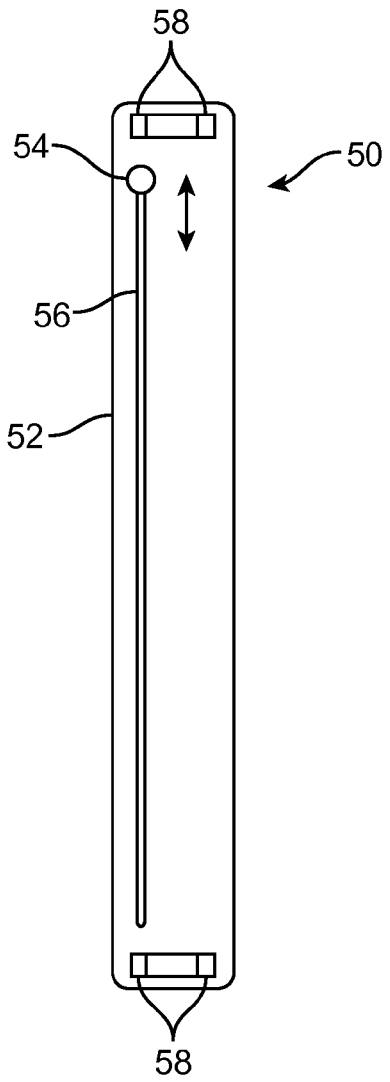
FIG. 5*a* is a front view of a cutter assembly 50 used in the self-adhesive paper system 10 shown in FIGS. 1 and 3.
Figure 5B:
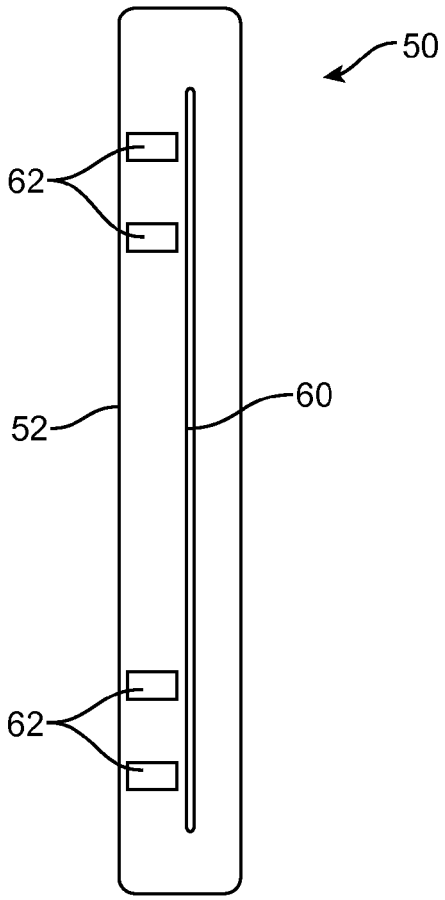
FIG. 5*b* is a rear view of a cutter assembly 50 shown in FIG. 5*a;*

Referring now to FIGS. 5*a* and 5*b*, front and rear views of the cutter assembly portion 50 of the self-adhesive paper system 10, the vertical slider slot 56 allows for manually guided vertical motion of the cutter blade 64 (not shown, see FIGS. 4*a* and 4*b*) and the cutter actuator 54. In use, a user 130 cuts the activity paper 15 by motioning the externally accessible button-shaped cutter actuator 54 from an upward starting position within the slider slot 56, downwardly to a bottom position, thereby correspondingly motioning the cutter blade 64 through the activity paper 15.

The cutter body 52 further comprises four (4) rollers 62 being that are attached along a rear surface of the cutter body 52 and along a common vertical axis. The rollers 62 rotate freely upon respective roller axles 63 that are integrated into the cutter body 52 (see FIG. 4*b*). The rollers 62 are envisioned as cylindrical plastic members having an outer covering of felt or equivalent soft material to protect the wall 125 as the activity paper 15 is dispensed. Furthermore, the rollers 62 are preferably arranged in vertical pairs in the cutter body 52 which are aligned with the adhesive 17 of the activity paper 15: one (1) pair aligned with a top strip of adhesive 17, and a second pair aligned with a bottom strip of adhesive 17. This arrangement provides coincidental positioning with respect to the pre-applied adhesive portion 17 to enable application of pressure to the adhesive 17 to secure the activity paper 15 to the wall 125 (see FIGS. 1 and 6*b*).

Figure 6A:
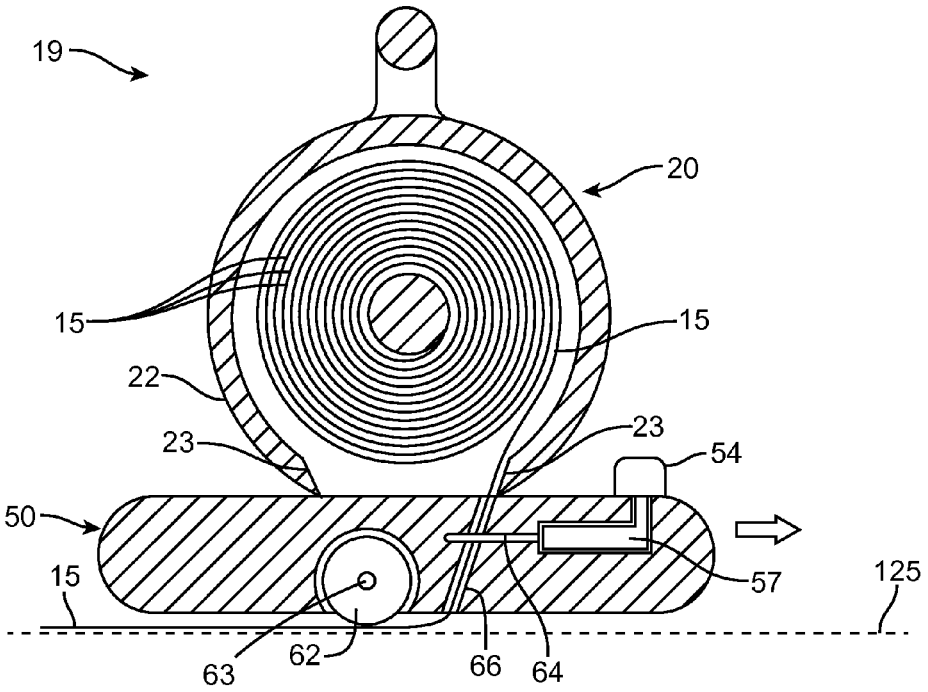
FIG. 6*a* is a section view of the self-adhesive activity paper system 10 taken along section line B-B of FIG. 2, but showing a left-handed use of the preferred embodiment of the present invention.
Figure 6B:
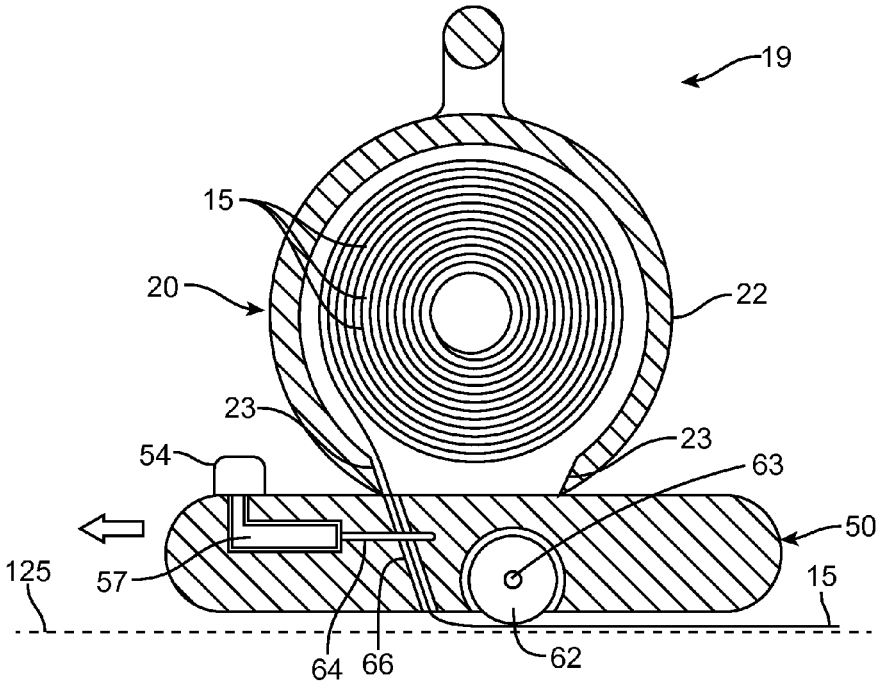
FIG. 6*b* is a section view of the self-adhesive activity paper system 10 taken along section line B-B of FIG. 2, but showing a right-handed use of the preferred embodiment of the present invention.

Referring now to FIGS. 6*a* and 6*b*, section views of the self-adhesive paper system 10 depicting left and right directional dispensing of the activity paper 15, the applicator 19 dispenses the activity paper 15 in either the left or right direction. This is accomplished by removing, inverting, and reinstalling the cutter assembly 50 on the cylinder assembly 20. The symmetrically positioned connector tangs 58 enable attachment to respective connector apertures 28 of the cylinder body 22 (see FIGS. 4*a* and 5*a*). Bi-directional operation of the self-adhesive paper system 10 enables dispensing the activity paper 15 in either direction as well as enabling easy use by both left-handed and right-handed users 130 (see FIG. 1).

Figure 7:
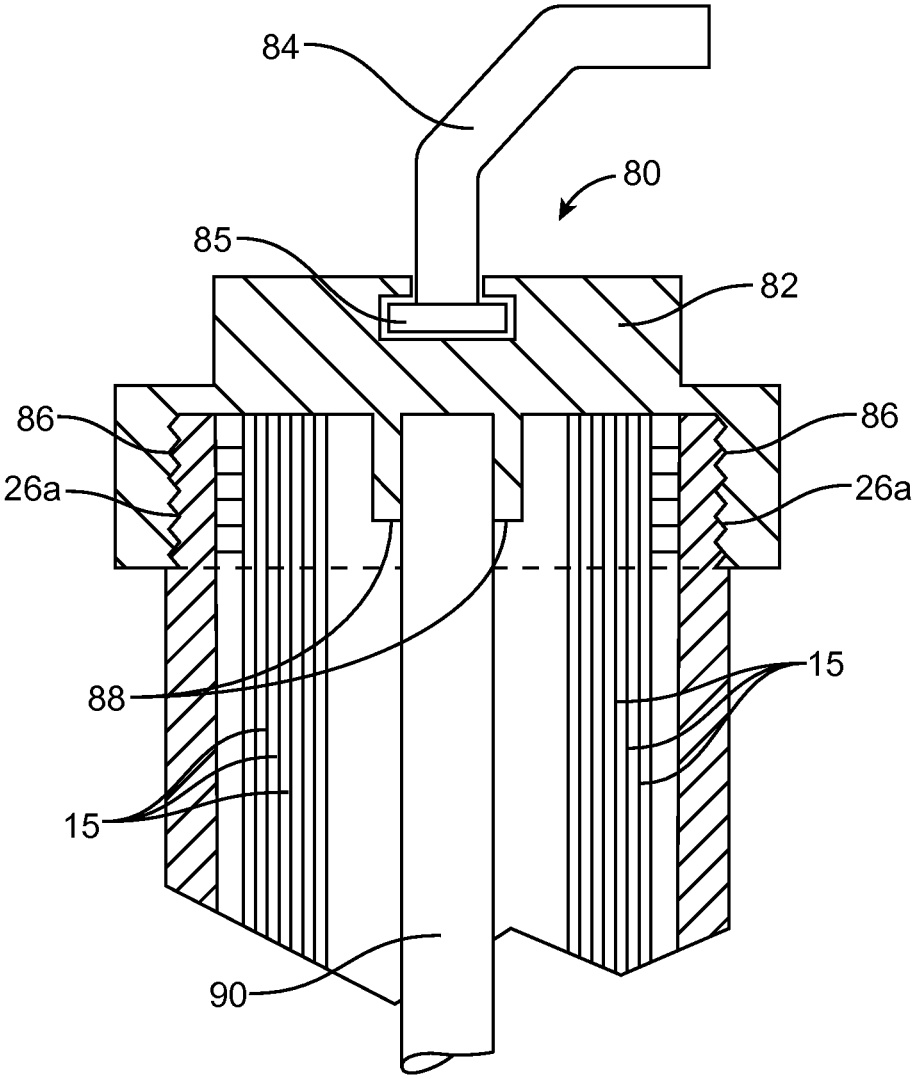
FIG. 7 is a section view of a upper cap assembly 80 taken along section line C-C of FIG. 2; and, FIG. 8 is a section view of a lower cap assembly 100 taken along section line D-D of FIG. 2.
Figure 8:
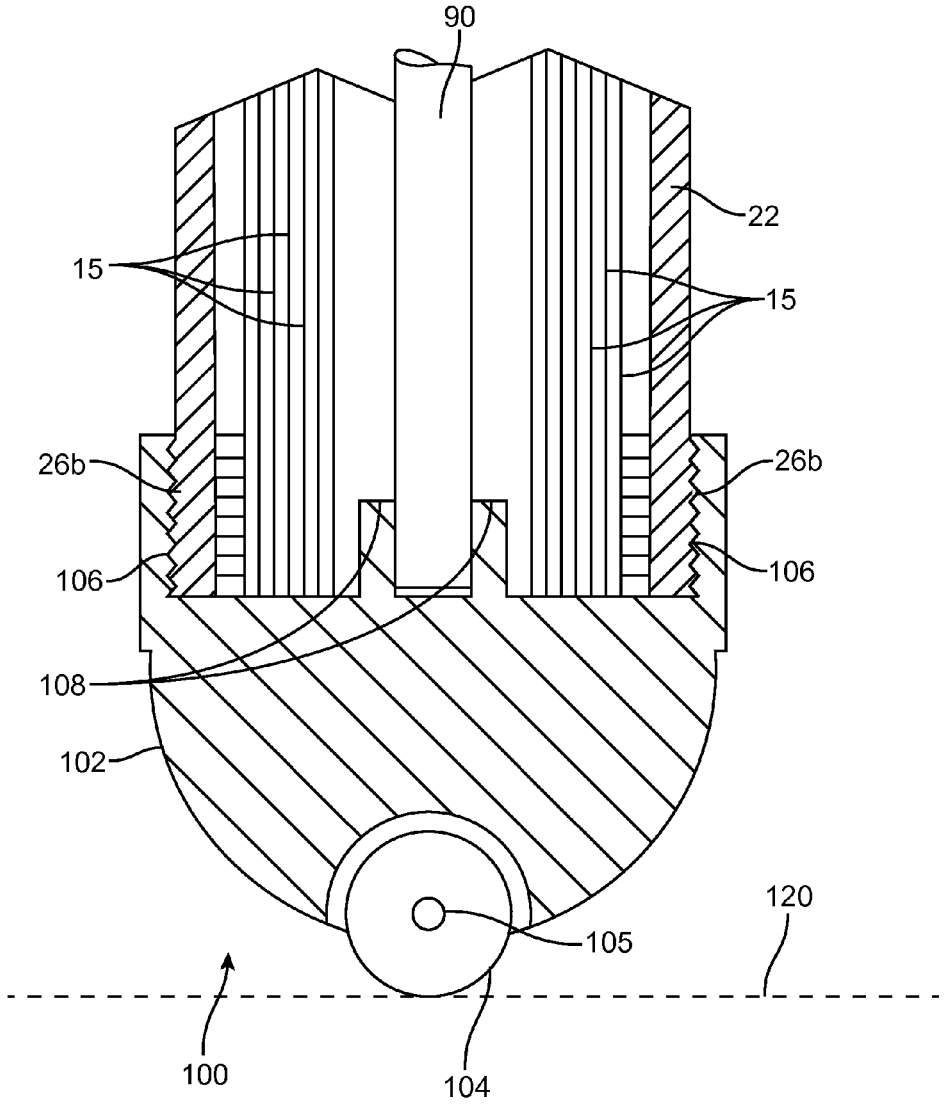

Referring now to FIGS. 7 and 8, section views of an upper cap assembly 80 and a lower cap assembly 100 of the self-adhesive paper system 10, the upper 80 and lower 100 cap assemblies comprise respective injection-molded plastic upper cap 82 and lower cap 102. The upper 82 and lower 102 caps provide respective attachments for an upper cap handle 84 and a lower cap wheel 104. The upper cap 82 and lower cap 102 provide for threaded attachments and closures of the intermediately located cylinder body 22 via respective upper cap female threaded region 86 and lower cap female threaded region 106. The upper and lower cap female threaded regions 86, 106 respectively engage with matching thread upper male threaded region 26*a* and lower male threaded region 26*b* of the cylinder body 22.

Additionally, the upper 80 and lower 100 cap assemblies capture and stably position the paper spool 90 along a common vertical center line via respective upper spool receiver 88 and lower spool receiver 108. The spool receivers 88, 108 comprise integrally-molded hollow cylindrically-shaped forms having open end portions dimensioned to receive the ends of the paper spool 90 (also reference FIGS. 2 and 3).

The upper cap assembly 80 has the attached upper cap handle 84 which includes an integrally-molded rotational disc feature 85 along at its bottom end. The upper cap handle 84 preferably takes the shape of an arcuate right angle appendage which provides a horizontal grasping feature for the user 130 while manipulating or carrying the self-adhesive paper system 10. The rotational feature 85 is loosely encompassed within the upper cap 82 so as to allow the upper cap handle 84 to rotate freely.

The lower cap assembly 100 locates the wheel 104 along the bottom of the lower cap 102. The wheel freely rotates on a center wheel axle 105 to allow the self-adhesive paper system 10 to smoothly glide along the floor 125 to accurately dispense the activity paper 15 on the wall 125 parallel to the floor 120 (see FIG. 1).

It is envisioned that other styles and configurations of the present invention can be easily incorporated into the teachings of the present invention. While only one particular configuration is shown and described that is for purposes of clarity and disclosure and not by way of limitation of scope.

The preferred embodiment of the present invention can be utilized by the common user in a simple and effortless manner with little or no training. After initial purchase or acquisition of the self-adhesive paper system 10, it would be assembled and utilized as indicated in FIGS. 1, 2 and 3.

The method of preparing the self-adhesive paper system 10 to apply activity paper 15 to a wall surface 125 is achieved by the following steps: procuring a model of the self-adhesive paper system 10 having a desired height; selecting a roll of activity paper 15 having a corresponding height and, if desired, pre-printed themes, designs, borders, color, and the like; loading the activity paper 15 into the applicator 19 by removing the upper cap assembly 80; inserting the paper spool 90 into the cylinder assembly 20 and into the lower spool receiver portion 108 of the lower cap assembly 100; inserting the roll of activity paper 15 over the paper spool 90; feeding and extending a short length of activity paper 15 through the cylinder paper slot 23 of the cylinder assembly 20; attaching the upper cap assembly 80 to the cylinder assembly 20; orientating the cutter assembly 50 either for right-hand or left-hand operation of the self-adhesive paper system 10; feeding the activity paper 15 through the cutter assembly paper slit 66; attaching the cutter assembly 50 to the cylinder assembly 20 by coincidentally inserting the connector tangs 58 into the corresponding connector apertures 28 until obtaining a secure snapping connection; and, routing the extended end of the activity paper 15 across the roller portions 62 of the cutter assembly 50. The self-adhesive paper system 10 is now ready to apply the activity paper 15 to a desired wall 125.

The method of utilizing the self-adhesive paper system 10 to apply activity paper 15 to a wall 125 may be achieved by performing the following steps: holding the self-adhesive paper system 10 securely with both hands by grasping the cylinder handle 24 and the upper cap handle 84; orientating the self-adhesive paper system 10 such that the activity paper 15 is parallel to the wall 125 onto which the activity paper 15 is to be applied; resting the wheel portion 104 of the lower cap assembly 100 on an adjacent floor 120; pressing the rollers 62 against the activity paper 15 and wall 125, thereby enabling the adhesive 17 of the activity paper 15 to adhere to the wall 125; moving the self-adhesive paper system 10 across the wall 125 while maintaining contact between the rollers 62 and the wall 125 until a desired length of activity paper 15 has been dispensed; terminating the activity paper 15 by moving the cutter actuator 54 downward within the slider slot 56 to cause the cutter blade 64 to vertically cut the activity paper 15; using the self-adhesive paper system 10 to dispense and adhere additional sections of the activity paper 15 as desired; using the affixed activity paper 15 for coloring, drawing, and the like; and then removing the activity paper 15 for when desired by detaching the temporary adhesive 17 of the activity paper 15 from the wall 125. The self-adhesive paper system 10 provides a user 130 the ability to allow children to draw or color in a creative manner while protecting the wall 125.

It is understood that the activity paper 15 may be replenished with a new roll of activity paper 15 as needed or it may be replaced with other activity paper 15 having different pre-printed characteristics. This is accomplished by removing the remaining activity paper 15 from the applicator 19 and performing the loading and preparing steps described above.

Additionally, the self-adhesive paper system 10 may be easily reconfigured for application of the activity paper 15 to the wall 125 in an opposite direction by detaching the cutter assembly 50 from the cylinder assembly 20 as described above; vertically flipping the cutter assembly 50; feeding the end of the activity paper 15 through the cutter assembly paper slit 66; reattaching the cutter assembly 50 to the cylinder assembly 20 via respective connector tangs 58 and connector apertures 28; and, utilizing the self-adhesive paper system 10 to adhesively apply the activity paper 15 in an opposite direction as described above.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A paper system, comprising:

an elongated cutter body having an elongated paper slit through said cutter body;

an elongated cylinder attached to said cutter body and having a top, a bottom, and an elongated paper slot that extends along said cylinder and that encompasses said paper slit;

a cylinder handle that extends from said cylinder;

an upper cap having an upper spool receiver, said upper cap attached to said top of said cylinder;

a lower cap having a lower spool receiver, said lower cap attached to said bottom of said cylinder;

a paper spool disposed between said upper spool receiver and said lower spool receiver;

a top handle attached to said upper cap;

a wheel attached to and extending from said lower cap; and, a cutter assembly having a blade within said cutter body that passes through said paper slit.

2. The paper system according to claim 1, further including activity paper on said paper spool and extending through said paper slit.

3. The paper system according to claim 2, further including temporary adhesive on said activity paper.

4. The paper system according to claim 3, wherein said temporary adhesive is applied in horizontal stripes.

5. The paper system according to claim 3, wherein said activity paper is preprinted with indicia.

6. The paper system according to claim 1, wherein said paper spool can be removed by detaching said upper cap or said lower cap.

7. The paper system according to claim 6, wherein said top and bottom are threaded, wherein said upper cap threads onto said top, and wherein said lower cap threads onto said bottom.

8. The paper system according to claim 1, wherein said cylinder can be detached from said cutter body, inverted 180°, and then reattached to said cutter body.

9. The paper system according to claim 8, wherein said cylinder includes a plurality of apertures, wherein said cutter body includes a plurality of connector tangs, and wherein said cylinder attaches to said cutter body using said plurality of apertures and said plurality of plurality of connector tangs.

10. The paper system according to claim 9, wherein said connector tangs are symmetrically arranged.

11. The paper system according to claim 8, further including a plurality of rollers attached to axles that are retained within said cutter body, wherein said plurality of rollers extend from said cutter body adjacent said cutter slit and opposite said cylinder.

12. The paper system according to claim 1, further including felt covering said rollers.

13. The paper system according to claim 12, wherein said rollers include a top pair of rollers and a bottom pair of rollers.

14. The paper system according to claim 1, wherein said cutter body further includes an "L"-shaped elongated cutting slot that extends from a surface adjacent said cylinder through said paper slit.

15. The paper system according to claim 14, wherein said cutter assembly includes a cutter actuator coupled to said blade and which extends from said cutting slot.

16. The paper system according to claim 15, wherein said cutter actuator can move said blade along said paper slit.

17. The paper system according to claim 15, wherein said cutting slot is formed from a blade slot and a slider slot.

18. The paper system according to claim 15, wherein said cutter actuator is coupled to said blade by a cutter plate.

19. The paper system according to claim 17, wherein said cutter actuator extends from said slider slot with a button-shaped handle.

20. The paper system according to claim 1, wherein said cylinder assembly is transparent.

* * * * *